US006108504A

United States Patent [19]

Dickhoff

[11] Patent Number: 6,108,504

[45] Date of Patent: Aug. 22, 2000

[54] CORONA WIRE REPLENISHING MECHANISM

[75] Inventor: Andreas Dickhoff, Rochester, N.Y.

[73] Assignee: Eastman Kodak Company, Rochester, N.Y.

[21] Appl. No.: 09/277,618

[22] Filed: Mar. 26, 1999

[51] Int. Cl.[7] ..... G03G 15/02

[52] U.S. Cl. ..... 399/170; 250/324

[58] Field of Search ..... 399/170, 115, 399/126, 100; 250/324, 325, 326; 361/225

[56] References Cited

U.S. PATENT DOCUMENTS

| | | | |
|---|---|---|---|
| 3,578,970 | 5/1971 | Michaud et al. | 361/225 X |
| 3,840,744 | 10/1974 | Hedman, Jr. | 250/325 X |
| 4,112,298 | 9/1978 | Weikel, Jr. . | |
| 4,258,258 | 3/1981 | Laing et al. . | |
| 4,603,964 | 8/1986 | Swistak | 250/325 X |
| 4,885,466 | 12/1989 | Koichi et al. | 250/326 X |
| 5,023,748 | 6/1991 | Okamoto et al. | 399/100 |
| 5,140,367 | 8/1992 | Oleksinski et al. . | |
| 5,181,069 | 1/1993 | Oleksinski et al. . | |
| 5,337,131 | 8/1994 | Sagiv et al. | 399/170 |
| 5,358,165 | 10/1994 | Andoh . | |
| 5,392,099 | 2/1995 | Kusumoto et al. | 250/325 X |
| 5,424,540 | 6/1995 | Garcia et al. . | |

*Primary Examiner*—Susan S. Y. Lee
*Attorney, Agent, or Firm*—Norman Rushefsky

[57] ABSTRACT

A corona charger includes a housing; a corona wire; and a wire replenisher located in the housing, the wire replenisher includes (i) a reversible motor; (ii) a rotatable shaft driven by the motor; (iii) a supply spool supporting a length of the corona wire; (iv) a tension mechanism tensioning corona wire supplied by the supply spool; and (v) a take-up spool located on the shaft.

12 Claims, 5 Drawing Sheets

CORONA WIRE REPLENISHING MECHANISM

CROSS REFERENCE TO RELATED APPLICATIONS

Reference is made to commonly assigned, copending U.S. patent application Ser. No. 09/280,119, entitled A METHOD OF MOUNTING CORONA WIRE INTO A CHARGER HOUSING OF AN ELECTROPHOTOGRAPHIC APPARATUS AND AN APPARATUS FOR MOUNTING CORONA WIRES, by Andreas Dickhoff; U.S. patent application Ser. No. 09/280,430, entitled A CORONA CHARGER WITH A SERPENTINE STRUNG CORONA WIRE, by Andreas Dickhoff; and U.S. patent application Ser. No. 09/280,121, entitled AN APPARATUS AND METHOD OF ATTACHING CORONA WIRE TO CORONA CHARGER HOUSING, by Andreas Dickhoff, all filed concurrently herewith.

FIELD OF THE INVENTION

The invention is in the field of electrophotography. More specifically, it is directed to a corona charger having a wire replenisher.

BACKGROUND OF THE INVENTION

A corona charger is used to generate an electrostatic charge on a surface, for example, a sheet of paper, a photoconductor or a transport web. A corona charger typically includes one or more tightly strung corona wires. The two ends of each wire are firmly attached to the charger housing, for example, by copper lugs, or by manually twisted loops which are connected to the charger housing. Applying high voltage to these corona wires creates the requisite charge.

The corona wires are usually mounted one by one. Mounting and adjusting the tension of each wire independently of other wires is time consuming and relatively expensive. In the mounting process the wire is touched multiple times by tools or by the operator's hand. The mounting process includes unpacking the wire, mounting one and of each wire into the corona charger, attaching a tensioning spring to the other end of each wire, and mounting this other end of each wire and the tensioning spring into the corona charger housing.

U.S. Pat. No. 5,353,165 discloses an automatic wiring machine of a corona charge device. This machine is very complex and very bulky.

SUMMARY OF THE INVENTION

It is an object of the present invention to provide an improved corona wire replenishing device. It is another object of the present invention to provide an electrophotographic apparatus with a corona charger that includes an automatic corona wire replenishing device.

According to the present invention, a corona charger comprises a housing, a corona wire, and a wire replenisher located in the housing. The wire replenisher includes (i) a reversible motor; (ii) a rotatable shaft driven by the motor; (iii) a supply spool supporting a length of the corona wire; (iv) a tension mechanism tensioning corona wire supplied by the supply spool; and (v) a take-up spool located on the shaft.

According to a preferred embodiment of the present invention a method of replenishing a corona wire in a corona charger, containing a wire replenisher with a supply spool and a take-up spool, includes the steps of: (i) rotating the supply spool in a first direction to transport a corona wire along a predetermined path and across a tensioning mechanism; and (ii) rotating the take-up spool to receive used corona wire.

BRIEF DESCRIPTION OF THE DRAWINGS In the drawings.

DETAILED DESCRIPTION OF THE INVENTION

Figure 1:
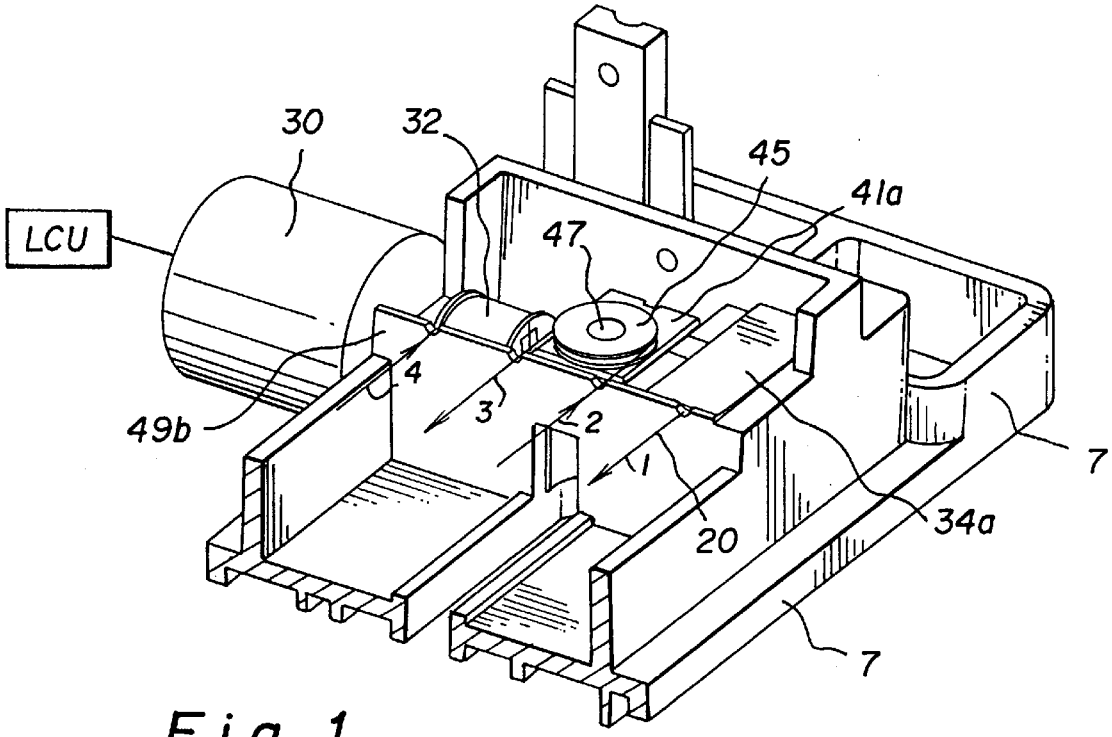
FIG. 1 is a perspective view of a cut-out front portion of a corona charger housing supporting a wire replenisher.
Figure 2:
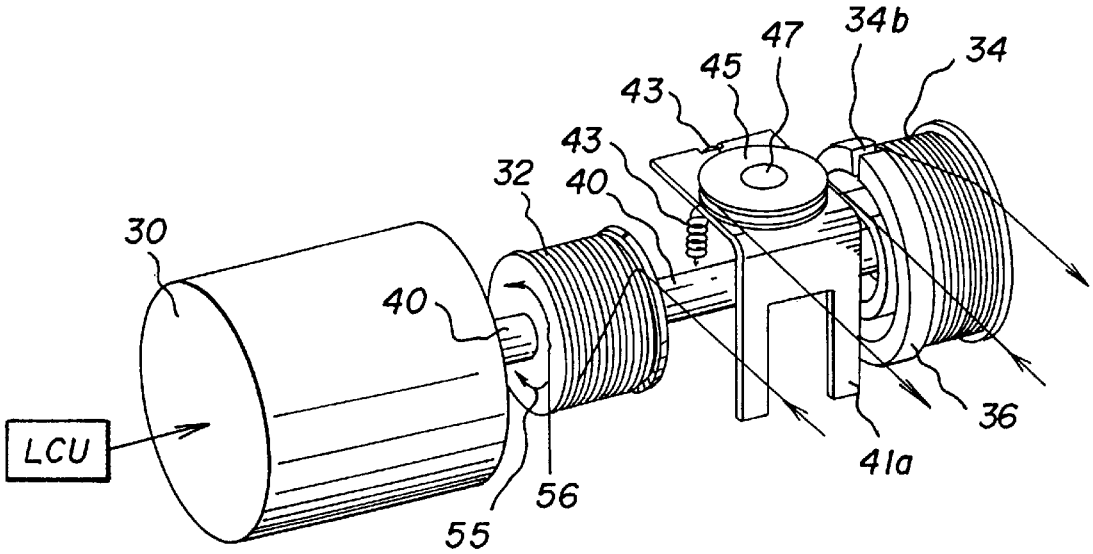
FIG. 2 is a perspective view of the wire replenisher of FIG. 1 without the housing.
Figure 7:
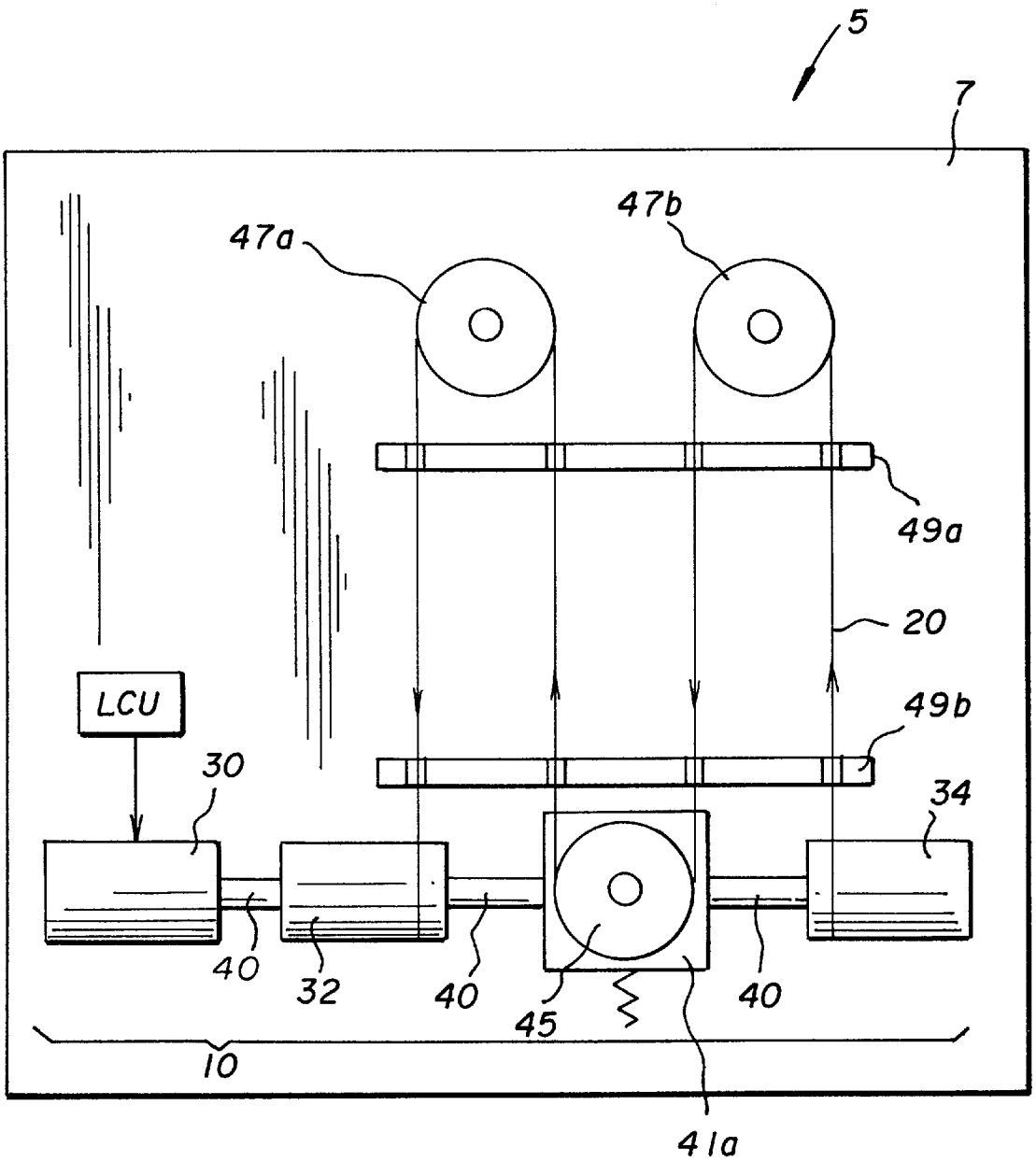
FIG. 7 is a top view of a corona charger including the wire replenisher, the corona wire and three rollers.
Figure 8:
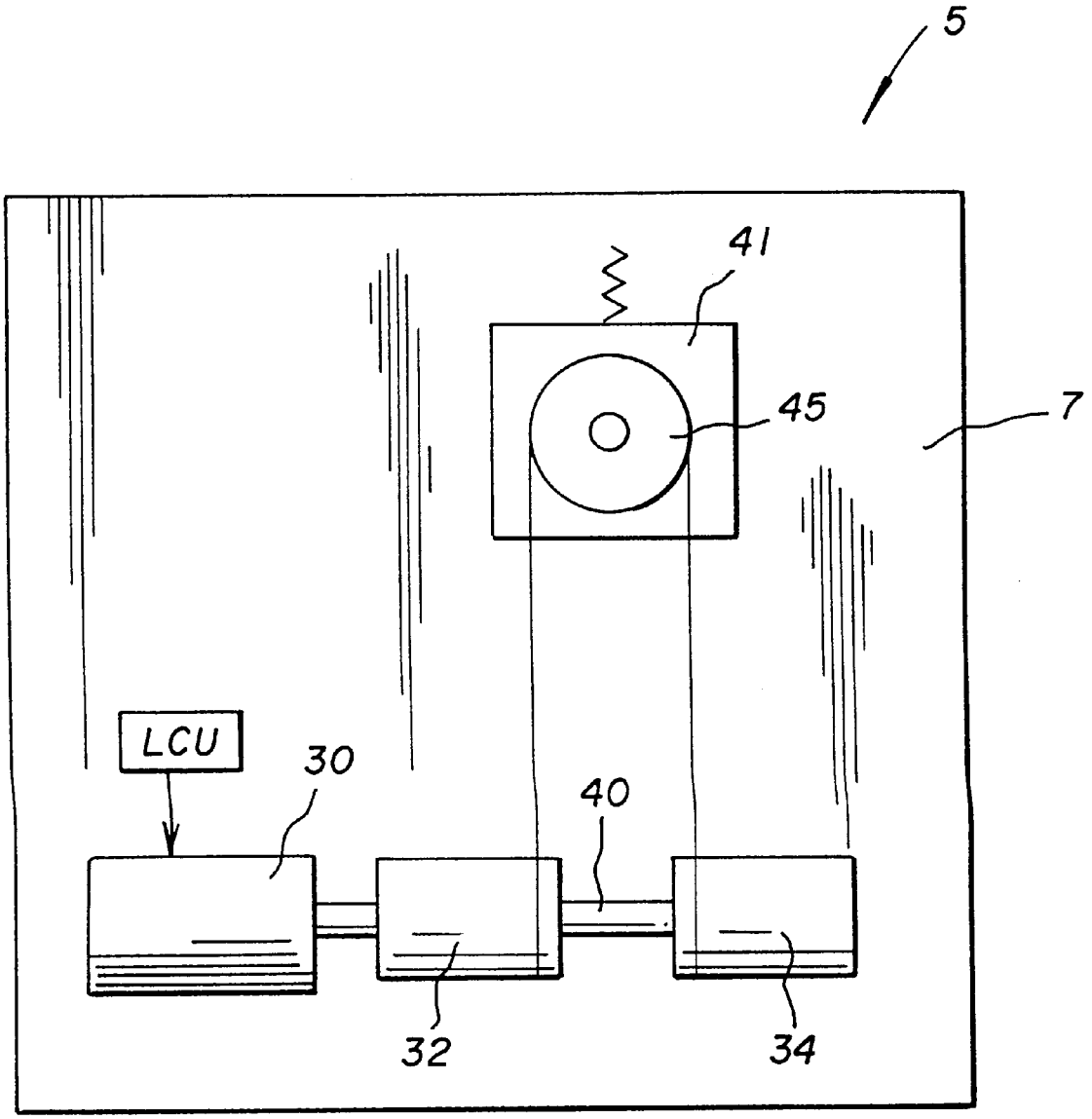
FIG. 8 is a top view of another corona charger.

With reference to FIGS. 1, 7 and 8, a corona charger 5 includes a corona charger housing 7 that supports a wire replenisher 10. The wire replenisher 10 replaces a set of corona wires 20 of the corona charger 5 by an automated process. The wire replenisher 10 replaces includes a reversible motor 30 that drives two spools 32, 34. In order to replace the wire 20 with the new wire the motor 30 is activated by a logic and control unit (LCU). (FIGS. 1, 2.) The spool 34 is usually covered by a cover plate 34*a* and is connected with a free wheel 36. This free wheel 36 includes two parts, an inner part mounted on the shaft 40 and the outer part mounted around the inner part. (See FIGS. 2, 3.) The spool 34 is mounted on the outer part of the free wheel 36. The free wheel 36 allows the spool 34 to rotate freely, in one direction, relative to the shaft 40, but prevents it from rotating in the opposite direction. This spool 34 is a supply spool and carries the new wire. The other spool, spool 32 is a take-up spool and it carries the used wire.

The take-up spool 32 is smaller in diameter than the supply spool 34. The new wire is installed during initial production into the wire replenisher 10. During the wire replacement operation of the charger, the empty supply spool 34 is replaced with a new, full supply spool 34 of corona wire 20 and the old wire is taken out with the take-up 32. An empty take-up spool 32 is then inserted into the place of the old spool 32. The main advantages of the present invention is that the wire 20 can be replaced 10 to 20 times (depending on the number and length of the corona wire strings and the volume of the supply spool) in the replenishing process before the corona charger 5 needs to be remanufactured.

Figure 3:
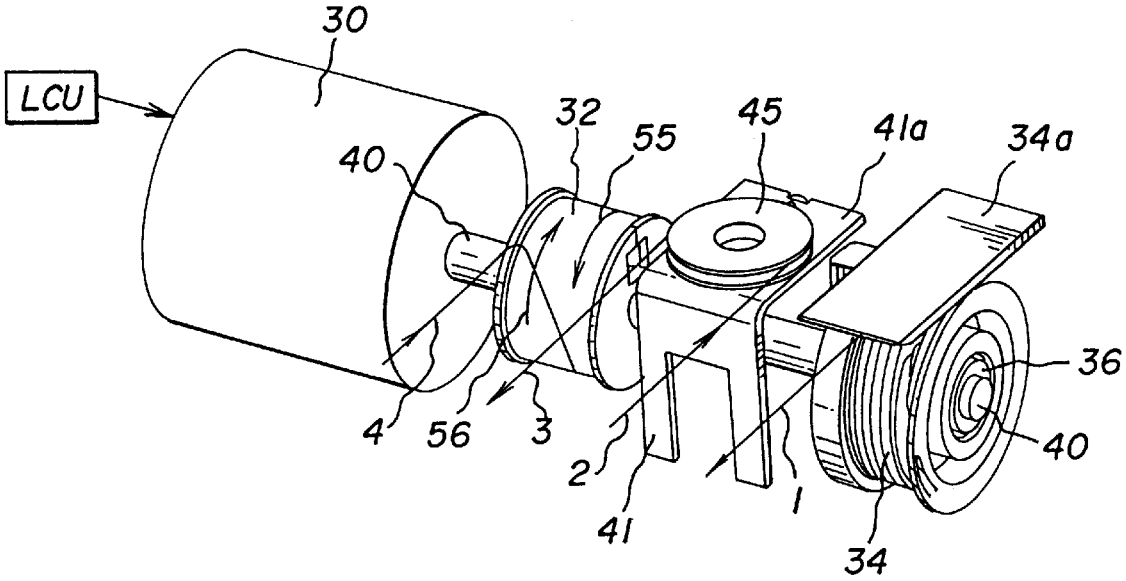
FIG. 3 is another perspective view of the wire replenisher of FIG. 1 without the housing.

FIG. 1 illustrates how the various components of the wire replenisher 10 fit in the front section of the corona charger housing 7. FIGS. 2 and 3 show the same components of the wire replenisher 10, but without the corona charger housing 7. As shown in these figures, the gear motor 30 is connected to a shaft 40. The shaft 40 is connected to the take-up spool 32 and the free wheel 36. As stated above, the supply spool 34, which holds the new wire, is mounted on the outer diameter of the free wheel 36. The supply spool 34 is plastic and provides insulation from a high voltage of corona charger wire 20. A tensioning bracket 41*a* is located between the two spools 32, 34. This tensioning bracket 41*a* is mounted into the corona charger housing 7 with the tension spring 43. A tension roller 45 is located on the tensioning bracket 41*a*. The tension roller 45 is mounted to be freely rotatable around the tension pin 47.

Figure 4:
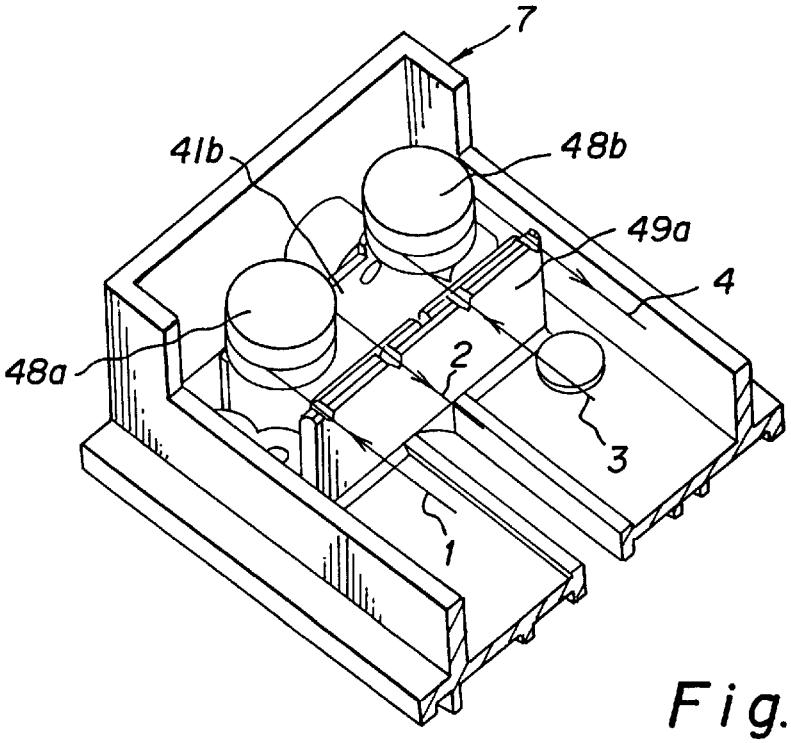
FIG. 4 is a perspective view of a cut-out rear portion of the corona charger housing with a set of rollers covered by roller covers.
Figure 5:
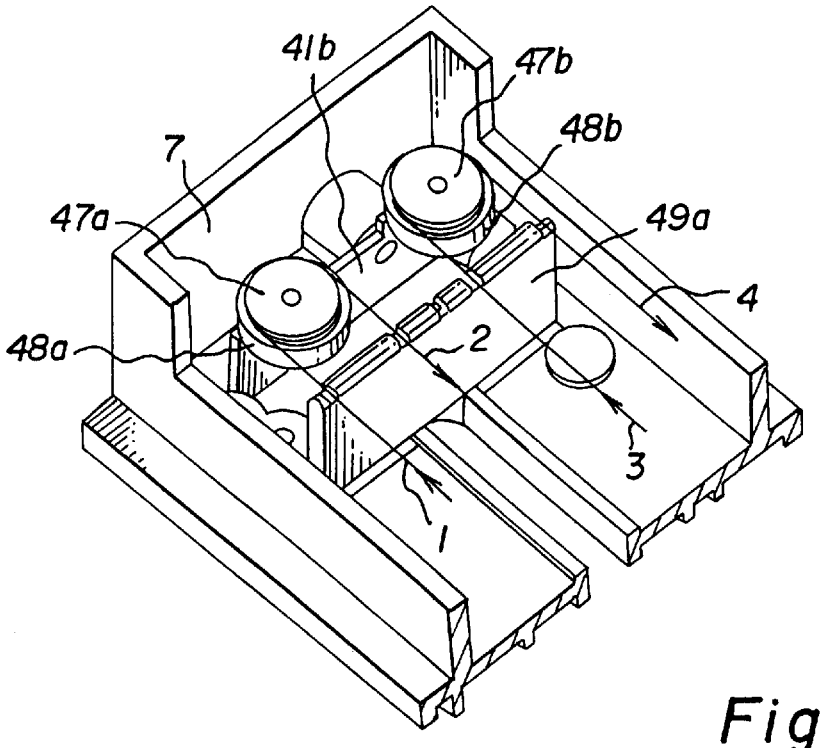
FIG. 5 is a perspective view of a cut-out rear portion of the corona charger housing with lower roller covers.
Figure 6:
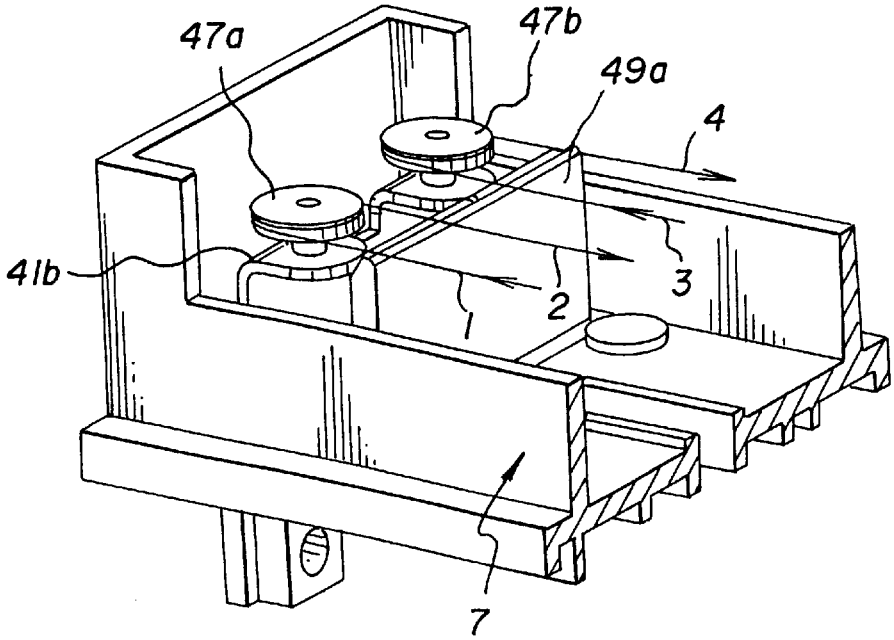
FIG. 6 is a perspective view of a cut-out rear portion of the corona charger housing, but without roller covers.

FIGS. 4, 5, and 6 show the rear section of the corona charger housing 7. In this embodiment, the rear section of the corona charger housing 7 supports a tension bracket 41*b*, with a plurality of contact rollers 47*a*, 47*b* mounted on the bracket 41*b* and a tensioning bridge 49*a*. The contact rollers 47*a*, 47*b*, in combination with the tension roller 45 guide the corona wire 20 along a serpentine path, thereby providing a plurality (four) parallel strings 1, 2, 3, 4 of the corona wire 20. The contact rollers 47*a*, 47*b* are in contact with a high voltage source (not shown). The rollers 47*a*, 47*b* are covered with insulating roller covers 48*a*, 48*b* in order to protect the rest of the corona charger housing 7 and other components from the high voltage. FIG. 4 illustrates the rear section of the corona charger housing 7 with roller covers 48*a*, 48*b* in place. FIG. 5 illustrates the rear section of the corona charger housing 7 with only the lower covers in place. FIG. 6 illustrates the rear section of the corona charger housing 7 without any roller covers. FIG. 7 is a schematic top view of the corona charger 5 with the four string corona wire. It is noted that the corona wire 20 may also be strung to provide either more, or fewer strings of corona charger wire 20. This is done by ether adding or removing rollers. For example, FIG. 8 illustrates a two string configuration.

More specifically, in the above embodiment with a four wire string configuration (FIG. 7) the wire 20 is tensioned over the entire serpentine path that follows from (i) the supply spool 34 over the bridges 49*b* and 49*a* to the contact roller 47*b* at rear end of the housing shell 7; (ii) from the contact roller 47*b*, over the two bridges 49*a* and 49*b*, back to the tension roller 45, (iii) from the tension roller 45, over the two bridges 49*b* and 49*a*, to the second contact roller 47*a*, and (iv) from there back over the two bridges 49*a* and 49*b*, to the take-up spool 32. The wire 20 is tensioned by the tension spring 43 via the tensioning bracket 41*a* and the tension roller 45. The tension is evenly distributed to all four strings 1, 2, 3, 4 of the wire 20 by the contact rollers 47*a*, 47*b*. The gear motor 30 supplies sufficient force necessary to hold the tensioned wire 20 in proper place on the spools 32 and 34.

The method of replenishing the wire is as follows:

First, the Logic and Control Unit (LCU) determines that wire 20 needs to be replaced by a new corona wire and sends a signal to activate the gear motor 30. The activated motor 30 drives the shaft 40 to rotate the take-up spool in the take-up spool's wind-up direction indicated by the arrow 55. (See FIG. 2.) During this time, both rollers 47*a*, 47*b* rotate with the same angular speed. Because the supply spool 34 is larger in diameter than the take-up spool 32 (see FIG. 2), the wire length between the spools 32, 34 increases until the tension roller 45 reaches its relaxed position driven by the tension spring 43. From now on, the supply spool 34 rotates slower than take-up spool 32. The wire transport speed over the whole length of the serpentine wire 20 is constant. The wire transport speed is determined by the speed of rotation of the take-up spool 32. The rotation of the supply spool 34 is not driven by the shaft 40, because of the free wheel 36. Instead, its rotation is driven by the pull force (created by the rotation of the take up spool) of the wire 20. The wire 20 is transported as far as needed (for example, one, two, three or four times the length of a wire string).

Then, the gear motor 30 reverses rotation direction. This direction is indicated by an arrow 56. Now both rollers rotate with the same angular speed because this is the direction where the free wheel 36 makes a stiff connection between the shaft 40 and the supply spool 34. When the gear motor 30 reverses its direction of rotation, the supply spool 34 takes more wire than the take-up spool 32. As the length of the wire between the spools 32 and 34 gets smaller the tension roller 45 is moved into the tension position. The gear motor 30 stops when the nominal tension is reached. When the tensioning bracket 41*a* reaches the position where it provides the nominal amount of tension, it activates a tension reader, a switch, for example, (not shown). This switch sends a signal to an LCU. The LCU, in turn, sends a signal to the gear motor to stop rotating. Alternatively, a built in timer can turn the gear motor 30 on and off at predetermined time intervals.

It is an advantage of the present invention that the manual corona wire replacement is eliminated and the corona wire replacement is done by an automatic wire replenisher mechanism. This results in the extended lifetime of the corona charger by a factor of 10–20, and in turn reduces the service costs significantly. Furthermore, because the handling of the corona wire itself is reduced to a minimum, the corona wire diameter can be reduced without impacting the handling.

The invention has been described in detail with particular reference to certain preferred embodiments thereof, but it will be understood that variations and modifications can be effected within the spirit and scope of the invention.

PARTS LIST

5 corona charger
7 corona charger housing
10 wire replenisher
20 corona wire
30 reversible motor
32 take-up spool
34 supply spool
36 free wheel
40 shaft of motor
41*a* tensioning bracket
41*b* bracket
43 tension spring
45 tension roller
47 tension pin
47*a*, 47*b* rollers
49*a*, 49*b* bridges
55 spool direction
56 tensioning direction

What is claimed is:

1. A corona charger comprising:

a housing;

a corona wire;

a wire replenisher located in said housing, said wire replenisher including:

(i) a reversible motor;

(ii) a rotatable shaft driven by said motor in one direction of rotation and in a second direction opposite the one direction;

(iii) a supply spool supporting a length of said corona wire;

(iv) a tension mechanism tensioning corona wire supplied by said supply spool; and (v) a take-up spool located on said shaft for rotation with the shaft; and (vi) a free wheel mounted on said shaft for rotation with said shaft and the free wheel being coupled with the supply spool for driving the supply spool in said one direction of rotation of the shaft and allowing the spool to rotate under tension of the corona wire to cause corona wire to be supplied by said supply spool when the shaft is driven in said second direction.

2. A corona charger according to claim 1, wherein said tension mechanism includes a tension roller and a tension spring.

3. A corona charger according to claim 1, wherein said tension mechanism includes a tension spring.

4. A corona charger according to claim 1, further comprising a plurality of rollers, one of said rollers being located to receive said corona wire from said supply spool and to provide said corona wire to said tension mechanism; and another one of said plurality of rollers being positioned to receive said corona wire from said tension mechanism and to provide said take-up spool with said corona wire.

5. A corona charger according to claim 4, wherein said tension mechanism includes a tension spring.

6. A corona charger according to claim 2, further comprising a plurality of rollers, one of said rollers being located to receive said corona wire from said supply spool and to provide said corona wire to said tension mechanism; and another one of said plurality of rollers being positioned to receive said corona wire from said tension mechanism and to provide said take-up spool with said corona wire.

7. A corona charger according to claim 1, wherein said supply spool has a larger radius than said take-up spool.

8. A corona charger according to claim 4, wherein said supply spool has a larger radius than said take-up spool.

9. A method of replenishing a corona wire in a corona charger containing a wire replenisher with a supply spool and a take-up spool both mounted for rotation about a common axis of rotation, said method including the steps of:

(i) rotating said supply spool about the common axis in a first rotational direction to transport a corona wire along a predetermined path and across a tension mechanism; and (ii) rotating said take-up spool about the common axis to receive used corona wire.

10. A method of replenishing a corona wire in a corona charger containing a corona wire, a wire replenisher that includes a motor operatively connected to a rotatable shaft supporting a take-up spool and a free wheel that supports a supply spool, and a tension mechanism having a tensioned position and a relaxed position, the corona wire being wound in a path between the supply spool, the tension mechanism and the take-up spool to provide a length of wire between the supply spool and the take up spool; said method including the steps of:

(i) operating said motor to rotate said shaft in a first direction to wind said corona wire onto the take-up spool;

(ii) transporting the corona wire between said supply spool, the tension mechanism and said take-up spool;

(iii) increasing the length of wire between the supply spool and the take-up spool;

(iv) placing said tension mechanism in a relaxed position;

(v) operating the motor to rotate said shaft in a direction opposite to said first direction;

(vi) decreasing the length of wire between the supply spool and the take-up spool;

(vii) placing said tension mechanism in a tensioned position; and (viii) stopping operation of said motor.

11. The method of claim 9 and wherein the tension mechanism includes a tension roller whose axis extends in a direction perpendicular to the common axis of rotation of the supply spool and take-up spool, and the tension roller moves in response to tension on the corona wire in a direction perpendicular to the directions of the axis of the tension roller and the common axis.

12. The method of claim 10 wherein in step (ii) the corona wire is transported additionally about a plurality of rollers wherein the rollers are spaced from the tension mechanism to establish corona wire lengths that are operative for corona charging.

* * * * *